US005785463A

United States Patent [19]

Eaton et al.

[11] Patent Number: 5,785,463

[45] Date of Patent: Jul. 28, 1998

[54] COMBINATION CABLE BOLT SYSTEM

[75] Inventors: Jack R. Eaton, Oakmont; Frank Calandra, Jr., Pittsburgh; John G. Oldsen, Butler, all of Pa.

[73] Assignee: Jennmar Corporation, Pittsburgh, Pa.

[21] Appl. No.: 584,977

[22] Filed: Jan. 11, 1996

[51] Int. Cl.[6] ..... E21D 20/00; E21D 20/02

[52] U.S. Cl. ..... 405/302.2; 405/259.5; 405/288

[58] Field of Search ..... 405/259.5, 259.6, 405/288, 302.1, 302.2

[56] References Cited

U.S. PATENT DOCUMENTS

| | | | |
|---|---|---|---|
| 3,077,809 | 2/1963 | Harding et al. | 411/33 |
| 3,324,662 | 6/1967 | McLean | 405/259.6 |
| 3,394,527 | 7/1968 | McLean | 52/741.1 |
| 3,896,627 | 7/1975 | Brown | 405/259.6 |
| 4,051,683 | 10/1977 | Koval | 405/259.6 |
| 4,477,209 | 10/1984 | Hipkins, Jr. et al. | 405/259.6 |
| 4,798,501 | 1/1989 | Spies | 405/260 |
| 5,230,589 | 7/1993 | Gillespie | 405/259.6 |
| 5,253,960 | 10/1993 | Scott | 405/302.2 |
| 5,259,703 | 11/1993 | Gillespie | 405/259.6 |
| 5,375,946 | 12/1994 | Locotos | 405/259.4 |
| 5,378,087 | 1/1995 | Locotos | 405/259.5 |
| 5,417,521 | 5/1995 | Scott | 405/259.6 |
| 5,458,442 | 10/1995 | Ashmore | 405/302.2 |
| 5,462,391 | 10/1995 | Castle et al. | 405/302.2 |
| 5,466,095 | 11/1995 | Scott | 405/302.2 |
| 5,511,909 | 4/1996 | Calandra, Jr. et al. | 405/302.2 X |
| 5,525,013 | 6/1996 | Seegmiller et al. | 405/302.2 X |

FOREIGN PATENT DOCUMENTS

| | | | |
|---|---|---|---|
| 230808A | 2/1990 | Japan | 405/302.2 |
| WO9303256 | 2/1993 | WIPO . | |

OTHER PUBLICATIONS

One-page advertisement for the Dywidag Tensionable Cable Bolt, Dywidag Systems International, USA, Inc. (Feb. 1994).

*Primary Examiner*—Tamara L. Graysay
*Assistant Examiner*—Tara L. Mayo
*Attorney, Agent, or Firm*—Webb Ziesenheim Bruening Logsdon Orkin & Hanson, P.C.

[57] ABSTRACT

A tensionable combination cable mine roof bolt is disclosed for use in resin grouted applications. The mine roof bolt includes a rod member having a rotatable bolt head at a first end thereof supporting a bearing plate and a threaded second end spaced from the first end. A coupling threadingly receives the rod member therein. A shearable stop device, such as a shear pin, is positioned within the coupling and adapted to stop the threaded rod member at a first position for rotation of the cable mine roof bolt during installation. After an upper portion of the cable mine roof bolt is secured, the shearable stop mechanism is subsequently sheared by the rod member to allow for tensioning of the cable mine roof bolt. A flexible multi-strand cable is coupled to the coupling device and forms the attachment point for the cable mine roof bolt.

17 Claims, 5 Drawing Sheets

COMBINATION CABLE BOLT SYSTEM

BACKGROUND OF THE INVENTION

1. Field of the Invention

The present invention relates to a cable mine roof bolt and, more specifically, to a tensionable combination cable mine roof bolt for resin grouted applications.

2. Description of the Prior Art

Resin grouted or quick setting adhesive-type mine roof bolts are well known, examples of which can be seen in U.S. Pat. Nos. 3,324,662 and 3,394,527. "Mine roof" bolts of the prior art and the present invention are not limited to mine roof applications, but can be used in many applications. The resin composition or quick setting adhesives principally include two components, first, a polyester resin and second, a catalyst. These components are separately retained within a breakable cartridge, one or more of which are positioned within the drilled bore hole.

Tensionable mine roof bolts for resin grouted applications are also known. Examples of these can be found in U.S. Pat. Nos. 3,896,627; 4,051,683 and 4,477,209. Each of these tensionable mine roof bolts requires two basic positions or movements of the mine roof bolt assembly. The first movement is one in which the entire assembly rotates to cause a rupturing and mixing of the resin adhesive and catalyst contained in one or more of the cartridges positioned in the bore hole. After the resin adhesive has cured to anchor the upper portion of the mine roof bolt, the second position of these tensionable bolts is to allow a lower portion of the bolt assembly to turn for tensioning of the roof bolt assembly in the rock strata.

The upper anchoring portion (i.e., from the coupling on up) of these prior art systems consists of a reinforcing rod having a threaded lower end. Long reinforcing rods are not readily adaptable for insertion into bore holes where the length exceeds the overhead clearance in the mine. In addition, severe roof conditions may necessitate the use of bolts having strength requirements exceeding standard reinforcing bonds.

It is an object of the present invention to overcome the aforementioned drawbacks of the prior art and to provide a tensionable mine roof bolt for resin grouted applications in which the elements for supporting a mine roof are easily inserted into mines of a low seam height or special roof conditions. It is a further object of the present invention to provide a tensionable mine roof bolt which is easily adapted for bore holes of varying depths. It is a further object of the present invention to provide an effective tensionable mine roof bolt which is economical to manufacture.

SUMMARY OF THE INVENTION

The objects of the present invention are achieved by providing a tensionable combination cable mine roof bolt specifically adapted for resin grouted applications in a bore hole. The combination cable bolt includes a rod member having a rotatable bolt head at a first end thereof which is adapted to support a bearing plate thereon. The rod member includes a threaded second end spaced from the first end. A coupling with an internally threaded bore hole is adapted to threadingly receive the second end of the rod member therein. A stop mechanism, such as a shear pin, is positioned within the coupling adapted to stop the rod member at a first position for rotation of the entire cable mine roof bolt to mix the resin. After an upper end of the cable mine roof bolt is fixed to the rock by the cured resin, the shearable stop mechanism is adapted to be sheared by continued rotation of the rod member to provide for tensioning of the cable mine roof bolt at the upper anchoring end of the combination cable bolt. A flexible multi-strand cable is coupled to the coupling and provides the attachment point for the cable mine roof bolt.

In one embodiment of the present invention, the cable mine roof bolt further includes a sleeve member attached to a lower end of a flexible multi-strand cable with the sleeve member having a threaded lower portion which is threaded into internal threads in the upper portion of the coupling. The sleeve member will have a central bore therein for receiving the lower portion of the cable for attaching thereto. The sleeve member may be attached to the cable by swaging, adhesives which may include metal powder or metal filings to improve the bonding effect, welding, or combinations thereof. Further, the central bore of the sleeve member may be tapered with a plurality of wedges positioned therein surrounding the multi-strand cable to secure the sleeve member to the cable.

In a second embodiment of the present invention, the coupling is adapted to be attached directly to a lower end of the flexible multi-strand cable. The coupling will include an upper bore in the upper portion thereof for receiving the lower end of the multi-strand cable for attaching the coupling thereto. The coupling may be attached to the lower end of the cable by swaging, adhesives which may include metal powder or metal filings to improve the bonding strength thereof, welding, or combinations thereof. Additionally, the upper bore of the coupling may be tapered and further includes a plurality of locking wedges surrounding the cable within the upper bore to secure the coupling to the multi-strand cable.

These and other objects of the present invention will be clarified in the brief description of the preferred embodiments taken together with the attached figures wherein like reference numerals represent like elements throughout.

BRIEF DESCRIPTION OF THE PREFERRED EMBODIMENTS

Figure 1:
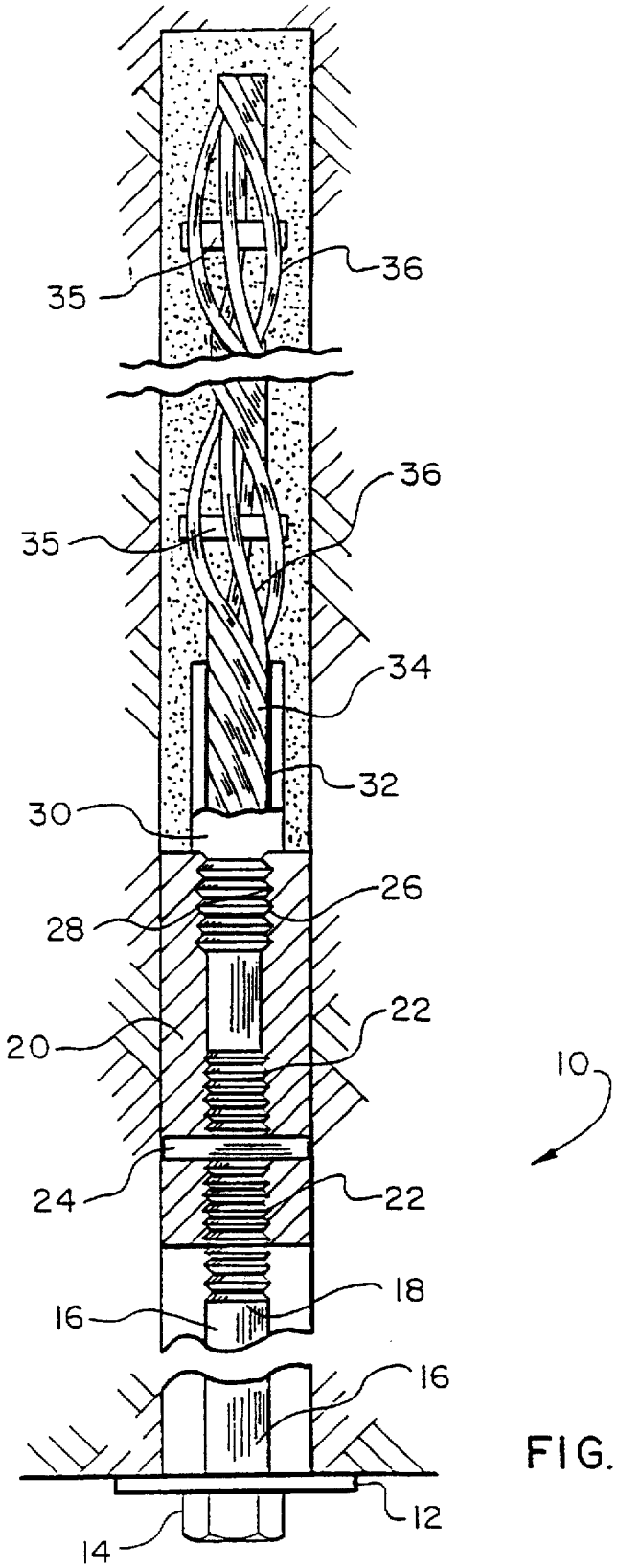
FIG. 1 is a side view, partially in section, of a combination cable mine roof bolt according to a first embodiment of the present invention.
Figure 2:
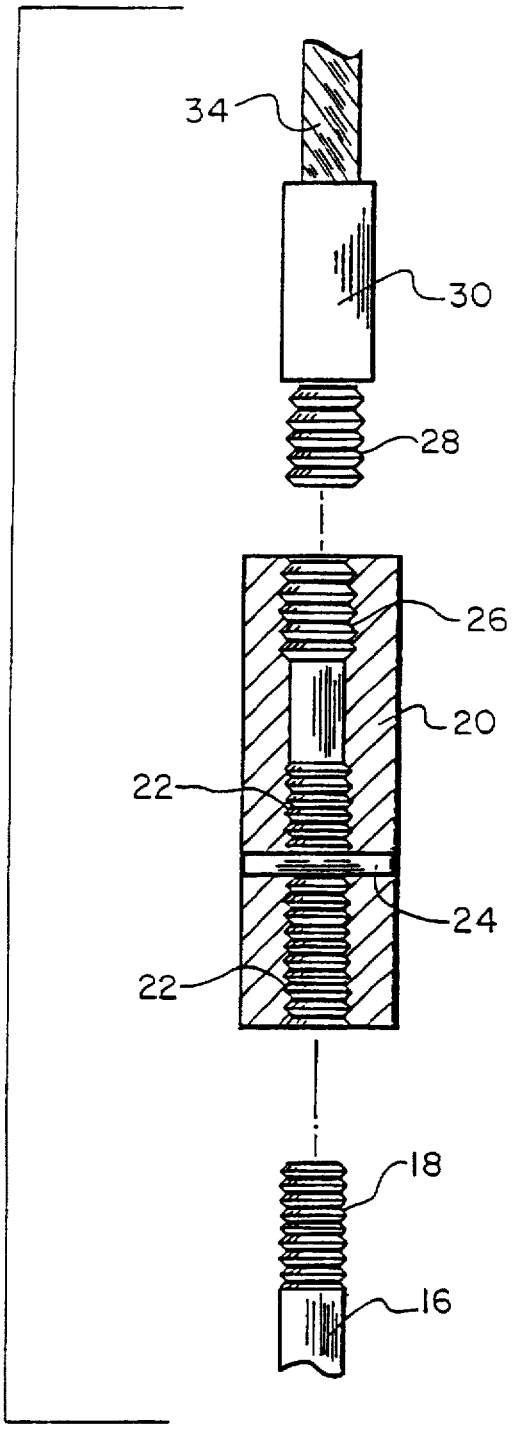
FIG. 2 is an enlarged, exploded view, partially in section, of a coupling and attachments thereto of the combination cable mine roof bolt of FIG. 1.

FIGS. 1 and 2 illustrate a tensionable combination cable mine roof bolt 10 according to a first embodiment of the present invention. The combination cable bolt 10 is adapted to be inserted into a drilled bore hole of a rock formation to support the rock formation, such as a mine roof overlaying a mine shaft, and the like.

A conventional bearing plate 12 is supported on a rotatable bolt head 14. The bolt head 14 preferably has a polygonal cross section, such as a square or a hexagon, so that the bolt head 14 can be easily driven by conventional mine bolt installing equipment. Appropriate washers may also be included between the bolt head 14 and the bearing plate 12, as needed.

A rod 16 extends or is attached from the bolt head 14 and includes external threads 18 on a second end thereof. The rod 16 may easily be formed from a solid bar as shown in the figures. However, as will be evidenced with the following description, rod 16 could be formed as a flexible cable with external threads 18 formed on an attached sleeve. The rod 16 is most likely to be most easily formed of a solid bar, as shown, since the present invention easily provides the upper portion of the combination cable bolt 10 to be of any desired length without significant concern to the mine overhead clearance. Therefore, the length of rod 16 may be maintained to an appropriate minimum.

A coupling 20 includes an internally threaded bore 22 at a first lower end thereof into which threads 18 of the rod 16 are threaded. A shear pin 24 is positioned within the coupling 20. The shear pin 24 may also be replaced by a plug member, a plastic sleeve, or other temporary stops as is known in the art. The upper or second end of the coupling 20 includes an upper threaded bore 26 into which the lower threaded end 28 of a sleeve member 30 is attached.

The sleeve member 30 includes a central bore 32 adapted to receive a lower end of a multi-strand cable 34 therein.

The cable 34 is preferably formed of a steel strand conforming to ASTM designation A 416 entitled "Standard Specification for Steel Strand, Uncoated Seven-Wire for Prestressed Concrete". The cable 34 is generally of a seven-strand type having a center strand enclosed tightly by six helically placed outer strands with a uniform pitch of between twelve and sixteen times the nominal diameter of the cable. The cable 34 is generally referred to by grade, with Grade 250 corresponding to an ultimate strength of 250,000 psi and Grade 270 corresponding to an ultimate strength of 270,000 psi. The cable 34 includes a plurality of nut cages or bird cages 36 positioned at spaced locations along the length of the cable 34. A conventional bird cage 36 is formed by a central nut or washer 35 positioned around the central strand of the cable 34 with the peripheral outer strands being held away from the central strand by the washer 35. The provision of bird cages 36 improves the mixing of the resin during installation as well as increasing the bond strength of the resulting anchorage. Swaged buttons attached to the cable 34 are an alternative mixing and holding device for resins and may be used alone or in combination with the bird cages 36.

The attachment of the sleeve member 30 to the cable 34 is essential to the combination cable bolt 10 with the bonding therebetween required to meet the loading requirements for the combination cable bolt 10. The upper portion of the sleeve member 30 around the central bore 32 may be swaged onto the multi-strand cable 34. Additionally, appropriate adhesives may be positioned within the central bore 32 to bond the sleeve member 30 to the cable 34 which is received within the central bore 32. When adhesives are used, metal filings or metal powder may be mixed in with the adhesives to increase the bonding. Additionally, the interior portion of the central bore 32 may be roughened or knurled to increase the bonding strength. An additional attaching technique is to weld the upper portion of the sleeve member 30 to the cable 34 around the exit of the central bore 32. All of these attachment techniques may be utilized in various combinations to the extent required to meet the loading requirements of the combination cable bolt 10 in the most economical and efficient fashion. The length of the sleeve member 30 and the corresponding central bore 32 is appropriately selected to provide the appropriate bonding area.

In operation, the combination cable bolt 10 is substantially similar to the tensionable cable bolts disclosed in U.S. Pat. Nos. 4,051,683 and 4,477,209 discussed above which are incorporated herein by reference. Appropriate resin cartridges (not shown) are inserted into the bore hole followed by the multi-strand cable 34 of the combination cable bolt 10. The rod 16 is rotated by bolt head 14 to thread rod 16 into coupling 20 until the rod 16 engages the shear pin 24. The shear pin 24 will stop the rod 16 allowing for rotation of the entire combination cable bolt 10. The rotation of the combination cable bolt 10 will cause the cable 34 to rupture the resin cartridges and appropriately mix the corresponding resin. After the resin has been appropriately mixed by rotation of the entire combination cable bolt 10, the resin is allowed to cure. The cylindrical coupling 20 is preferably sized to provide a resin compression dam for the resin within the bore hole. Additionally, an extra resin compression dam may be attached on the cable 34 if a longer cable 34 is utilized.

After the resin is cured, the rod 16 is rotated by bolt head 14 to shear the shear pin 24 and then to further thread the rod 16 into the coupling 20 to appropriately tension the entire combination cable bolt 10.

The combination cable bolt 10 of the present invention offers several distinct advantages over the tensionable bolts of the prior art. The cable 34 is substantially easier to fit into a bore hole than the elongated rods of the prior art system. The cable 34 is additionally lighter and easier to transport. The cable 34 exhibits greater mixing and bonding capabilities by provision of bird cages 36. Furthermore, the cable 34 can be easily adjusted to bore holes of any length regardless of the height limitations in the mine due to the flexibility of the cable 34. Finally, the strength capacity of cables exceeds conventional rebar and, therefore, cable is the preferred reinforcement for certain roof conditions.

Figure 3:
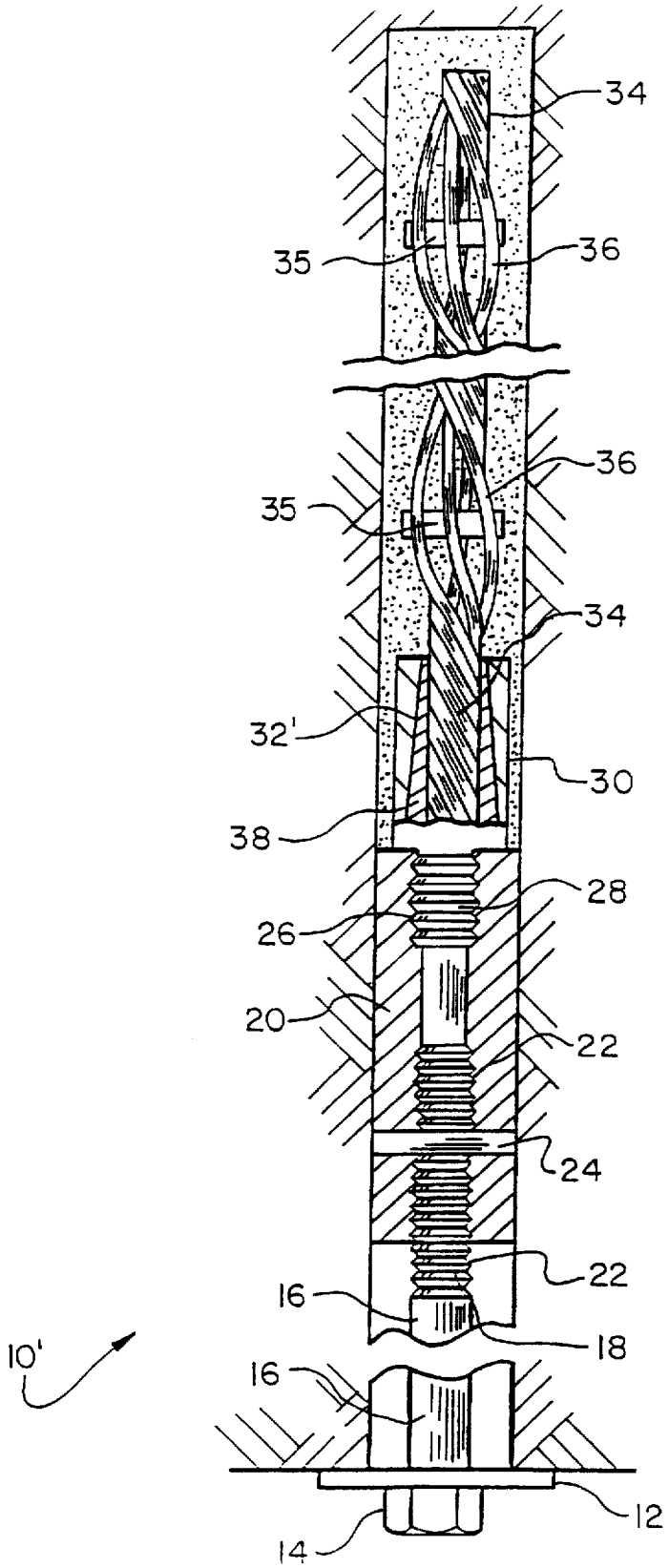
FIG. 3 is a side view, partially in section, of a modified version of the cable mine roof bolt illustrated in FIG. 1.

FIG. 3 illustrates a combination cable mine roof bolt 10' which is slightly modified from the combination cable bolt 10 illustrated in FIG. 1. The combination cable bolt 10' includes a bearing plate 12, bolt head 14, rod 16 with threads 18, coupling 20 with internally threaded bore 22, shear pin 24 and upper threaded bore 26 identical to those described in the combination cable bolt 10 shown in FIG. 1. Additionally, the lower threaded end 28 of the sleeve member 30 as well as the multi-strand cable 34 with spaced bird cages 36 with washers 35 are identical to those described in the combination cable bolt 10 of FIG. 1. The combination cable bolt 10' illustrated in FIG. 3 differs from combination cable bolt 10 illustrated in FIG. 1 in the manner in which the multi-strand cable 34 is attached to the sleeve member 30. In the combination cable bolt 10', the central bore 32' of the sleeve member 30 is tapered in an inward direction extending upwardly along the combination cable bolt 10'. A plurality of locking wedges 38 is positioned within the central bore 32' to surround the multi-strand cable 34 to secure the cable 34 to the sleeve member 30. The locking wedges 38 within the central bore 32' operate substantially as a barrel and wedge assembly. Barrel and wedge assemblies have long been used in cable bolts. The locking wedges 38 and tapered central bore 32' may be utilized in conjunction with other attaching techniques, such as adhesives or welding and possibly swaging, to provide the appropriate strength to the attachment of the sleeve member 30 to the cable 34 in the combination cable bolt 10'. The combination cable bolt 10' operates in the same manner as the combination cable bolt 10 described above. The combination cable bolt 10 and combination cable bolt 10' of FIGS. 1–3 additionally provide the advantage that existing couplers can be utilized to form the coupling 20, thereby minimizing the number of new parts to be manufactured to construct the combination cable bolts 10 and 10' of the present invention.

Figure 4:
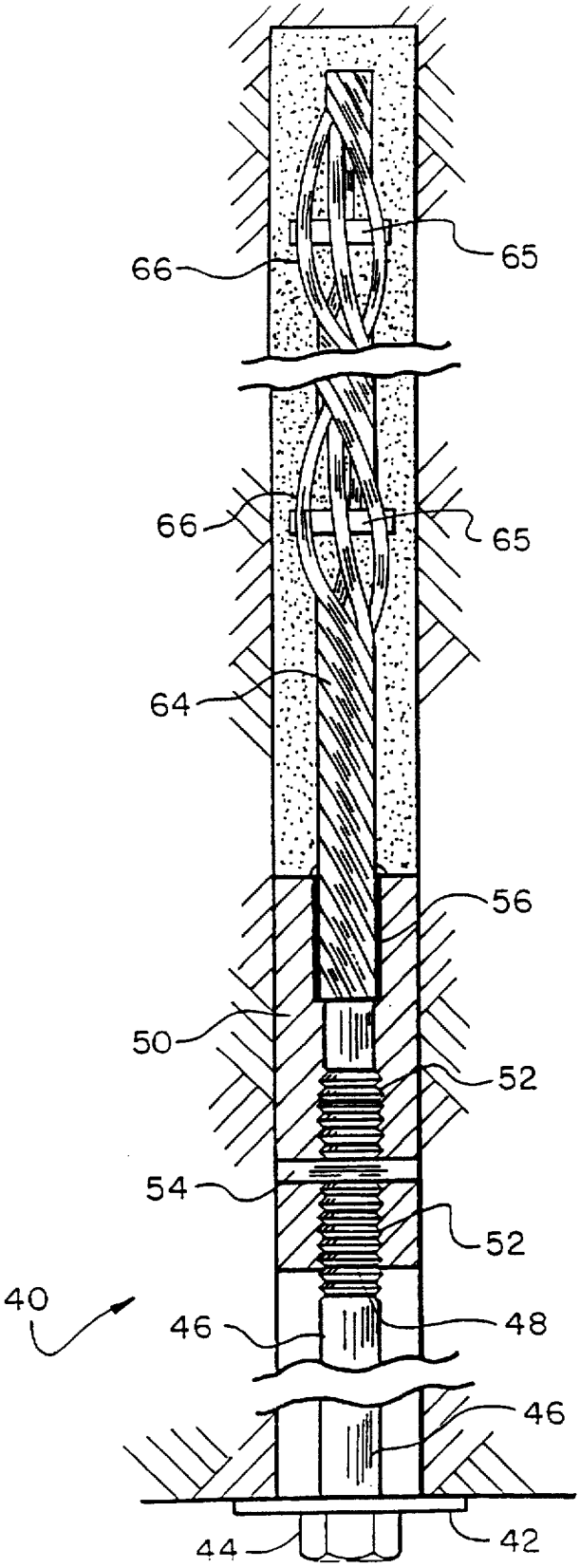
FIG. 4 is a side view, partially in section, of a combination cable mine roof bolt according to a second embodiment of the present invention.

FIG. 4 illustrates a combination cable bolt 40 according to the second embodiment of the present invention. Combination cable bolt 40 includes a bearing plate 42, rotatable bolt head 44 and rod 46 with external threads 48 at one end which are identical to the bearing plate 12, bolt head 14, rod 16 and threads 18 described above. A coupling 50 with an internally threaded bore 52 into which the rod 46 is threaded and shear pin 54 are substantially identical to the coupling 20, threaded bore 22 and shear pin 24 discussed above. The coupling 50 includes an upper bore 56 attached directly to a multi-strand cable 64 with spaced bird cages 66 including washers 65. The cable 64 and bird cages 66 are identical to the cable 34, washers 35 and bird cages 36 discussed above.

The lower portion of the cable 64 is received within the upper bore 56 and the coupling 50 is attached to the cable 64 in the same manner as the sleeve member 30 is attached to the cable 34 discussed above. Specifically, the cable 64 can be attached in the upper bore 56 by (1) swaging of the coupling 50 around the upper bore 56; (2) use of adhesives which may further include metal powder or metal filings therein together with the roughing of the upper bore 56; (3) welding; or (4) various combinations thereof. The specific combination of these attachment techniques is selected to meet the loading requirements of the combination cable bolt 40 in the most economical and efficient fashion. Combination cable bolt 40 will operate in the same manner as combination cable bolts 10 and 10' described above.

Figure 5:
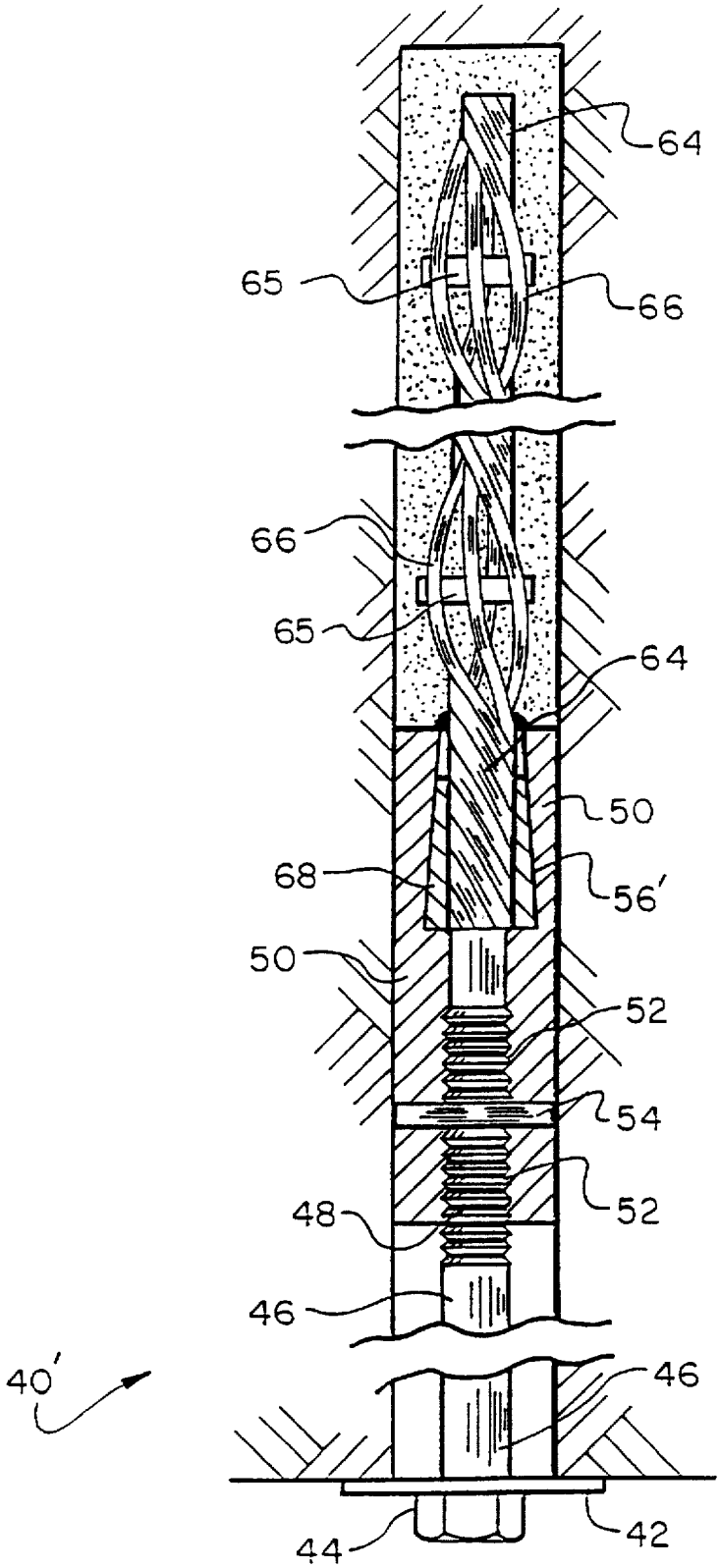
FIG. 5 is a side view, partially in section, of a modified cable mine roof bolt illustrated in FIG. 4.

FIG. 5 illustrates a modified combination cable bolt 40' which differs from the combination cable bolt 40 described in connection with FIG. 4 only in the manner in which the cable 64 is attached to the coupling 50. In the combination cable bolt 40', an upper bore 56' of the coupling 50 is tapered to receive a plurality of locking wedges 68 therein to surround the lower portion of the cable 64 to secure the cable 64 to the coupling 50. This arrangement is substantially similar to the use of the locking wedges 38 and the sleeve member 30 in the combination cable bolt 10' described in connection with FIG. 3. The locking wedges 68 may also be used in connection with other attaching techniques, such as swaging of the upper portion of the coupling 50 around the tapered upper bore 56', adhesives within the upper bore 56', welding of the multi-strand cable 64 to the upper end of the coupling 50, or various combinations thereof.

It will be apparent to those of ordinary skill in the art that various changes and modifications may be made to the present invention without departing from the spirit and scope thereof. Consequently, the scope of the present invention is intended to be defined by the attached claims.

What is claimed is:

1. A tensionable combination cable mine roof bolt comprising:

a rod member having a rotatable bolt head at a first end thereof for rotating said rod member and adapted to support a bearing plate thereon, and a threaded second end;

a coupling with internal threads adapted to receive said rod member;

a shearable stop means within said coupling adapted to stop said rod member for rotation of said bolt, and adapted to subsequently be sheared by said rod member to tension said bolt; and a flexible multi-strand cable coupled to said coupling.

2. The combination cable bolt of claim 1 further including a sleeve member attached to a lower end of said flexible multi-strand cable, said sleeve member attached to said coupling.

3. The combination cable bolt of claim 2 wherein said sleeve member includes a threaded lower end adapted to be threaded into said coupling.

4. The combination cable bolt of claim 3 wherein said sleeve member includes a central bore receiving said cable therein.

5. The combination cable bolt of claim 4 wherein said sleeve member is attached to said cable by adhesives.

6. The combination cable bolt of claim 5 further including metal filings mixed with said adhesives for attaching said sleeve member to said cable.

7. The combination cable bolt of claim 4 wherein said sleeve member is attached to said cable by swaging.

8. The combination cable bolt of claim 4 wherein said central bore is tapered and further including a plurality of locking wedges surrounding said cable within said central bore attaching said cable to said sleeve member.

9. The combination cable bolt of claim 1 wherein said coupling includes an upper bore receiving said cable therein.

10. The combination cable bolt of claim 9 wherein said coupling is attached to said cable by adhesives.

11. The combination cable bolt of claim 10 further including metal filings mixed with said adhesives for attaching said coupling to said cable.

12. The combination cable bolt of claim 9 wherein said coupling is attached to said cable by swaging.

13. The combination cable bolt of claim 9 wherein said upper bore is tapered and further including a plurality of locking wedges surrounding said cable within said upper bore attaching said coupling to said cable.

14. A tensionable combination cable mine roof bolt for insertion into a bore hole, adapted for resin grouted applications, said bolt comprising:

a bearing plate;

a rotatable bolt head supporting said bearing plate thereon;

a rod attached to the first end thereof to said bolt head, said rod being rotatable by said bolt head and having an externally threaded second end;

a coupling having an internally threaded bore at a first end thereof adapted to receive said externally threaded second end of said rod therein;

a removable stop means positioned within said coupling for maintaining said rod in a first position within said coupling to provide rotation of said combination cable mine roof bolt; and a flexible cable coupled to a second end of said coupling, wherein when said flexible cable is adapted to be secured within the bore hole by said resin grouting, said removable stop means is adapted to be removed by threading of said rod into said coupling to permit tensioning of said combination cable bolt.

15. The combination cable bolt of claim 14 further including a sleeve member attached at a lower end of said flexible multi-strand cable, said sleeve member having a threaded lower end which is threaded into said second end of said coupling.

16. The combination cable bolt of claim 15 wherein said sleeve member is attached to said cable by one of the group consisting of swaging, adhesives, welding, and combinations thereof.

17. The combination cable bolt of claim 14 wherein said multi-strand cable is connected directly to said coupling by one of the group consisting of swaging, adhesives, welding, and combinations thereof.

* * * * *